US005284101A

United States Patent [19]

Oder et al.

[11] Patent Number: 5,284,101

[45] Date of Patent: Feb. 8, 1994

[54] AFTER HOUR DEPOSITORY DOOR SECUREMENT MECHANISM

[75] Inventors: Charles D. Oder, Hamilton; Douglas W. Lohrey, Somerville, both of Ohio

[73] Assignee: Mosler Incorporated, A Corp. of De, Hamilton, Ohio

[21] Appl. No.: 808,183

[22] Filed: Dec. 13, 1991

[51] Int. Cl.[5] ..... E05G 1/024

[52] U.S. Cl. ..... 109/46; 109/66; 232/44

[58] Field of Search ..... 109/59 R, 66, 73, 23, 109/46; 232/43.3, 44, 45, 47, 57

[56] References Cited

U.S. PATENT DOCUMENTS

| | | | |
|---|---|---|---|
| 2,581,621 | 1/1952 | Behrens et al. | 232/44 |
| 2,617,584 | 11/1952 | Behrens | 232/44 |
| 3,465,955 | 9/1969 | De Boer et al. | 232/44 |
| 3,704,825 | 12/1972 | Hinohara et al. | 232/44 |
| 4,063,520 | 12/1977 | Parsons | 232/44 X |
| 4,176,610 | 12/1979 | Markham et al. | 109/66 X |
| 4,466,357 | 8/1984 | Masachika | 232/44 X |
| 4,489,662 | 12/1984 | Masachika | 232/44 |
| 4,573,416 | 3/1986 | Masachika | 232/44 |
| 4,665,839 | 5/1987 | Heyl | 232/43.3 X |

*Primary Examiner*—Peter M. Cuomo
*Assistant Examiner*—Suzanne L. Dino
*Attorney, Agent, or Firm*—Wood, Herron & Evans

[57] ABSTRACT

An improved night depository for depositing an article through the wall of a building into a safe. The depository includes a casing that is mounted within an opening in the wall and a receptacle pivotally mounted about a horizontal axis within the casing. The receptacle includes a door, two vertical sides, and a floor. One end of a movable wall is pivotably mounted to the outboard end of the receptacle floor. When the receptacle is rotated about the horizontal axis to open the door the unattached end of the movable wall pivots towards the receptacle floor. The receptacle sides are separated from the edges of the movable wall by a clearance that is sufficiently small enough to impede the flow of air about the edges of the movable wall as the movable wall pivots. The air underneath the movable wall escapes through a gap between the unattached end of the movable wall and the door at a rate which cushions the impact of the unattached end against the receptacle floor. The depository also includes an eccentric detent pivotably mounted about a member that extends from the receptacle side wall. The detent travels within a recessed channel between two walls with stationary dogs mounted along one of the walls. When the door is closed, a lip rotates the detent for downward passage through the recessed channel. Any subsequent attempt to open the door causes the detent to jam within the recessed channel to prevent the door from opening.

6 Claims, 8 Drawing Sheets

AFTER HOUR DEPOSITORY DOOR SECUREMENT MECHANISM

FIELD OF THE INVENTION

This invention relates to night or after hour depositories.

BACKGROUND OF THE INVENTION

Night depository boxes and their construction are well known. Such depositories are used for the secure depositing of articles, such as envelopes or money bags, into a vault within a bank without the assistance of an attendant. The article is deposited within a receptacle in the depository when the depository door is opened and the article is ejected from the receptacle into the vault when the door is closed. The depository door and receptacle cooperate to prevent access to the vault when the door is in both its open and closed positions.

When the door of a typical depository is unlocked and pivoted open to deposit the article in the receptacle which pivots with the door, access to the chute remains blocked by the floor of the receptacle and a hinged wall attached thereto. When the door is pivoted shut the hinged wall ejects the article from the receptacle into the vault and moves to a position that separates the receptacle from the vault. The action of the receptacle floor and hinged wall during opening and closing of the door with interlocking ribs prevents a thief from inserting a line and hook into the vault by way of the receptacle to 'fish out' the contents of the vault. Thus, a thief cannot gain access to the vault by merely defeating the door lock mechanism since the receptacle and hinged wall cooperate to block access to the vault.

Another feature of the typical depository is a detent mechanism that ensures the depository door is fully closed to eject the article from the receptacle once a deposit has been made and the closing motion has begun. This mechanism prevents someone from prematurely stopping the door closure motion and re-opening the door to remove the article from the receptacle before the hinged wall ejects the article from the receptacle into the vault.

The detent mechanisms previously known usually include springs, ratchet pawls, spring biased levers and other actively engaged mechanical components to stop the reverse motion of the mechanical component, such as a cam or link arm, that controls the motion of the door. Such detent mechanisms are more difficult to produce, sometimes jam since intermeshing mechanical parts are required and are more costly to construct because the mechanism components need careful alignment for reliable and effective operation. What is needed is a simple, yet reliable, door detent mechanism that requires few interacting parts and can be produced inexpensively.

Another problem with known bank depositories having a pivotable wall to eject the contents of the depository into the vault is the noise produced by their operation. The article-ejecting wall is attached, usually by means of a hinge or the like, to the end of the receptacle floor outboard from the door. When the door is closed, the receptacle floor tilts downwardly from the door and the pivotable wall is substantially perpendicular to the floor so the wall substantially covers the opening from the receptacle to the vault. When the hinged wall pivots toward the depository door as the depository door is pivoted open, the unattached end of the wall falls until it impacts the floor or bottom of the depository receptacle with a noticeable bang. This noise can alert a thief hiding out of sight nearby that a deposit is being made so the thief can surprise the depositor and forcibly take the article before the depositor closes the depository door. What is needed, therefore, is the elimination of this noise, which occurs when the pivotable wall impacts the receptacle floor.

SUMMARY OF THE INVENTION

According to the principles of the present invention, a night depository is provided that ensures full closing of the depository door once closure has been initiated and does so with minimal structural complexity, while affording maximum reliability and resistance to jamming. A night depository constructed according to the principles of the present invention also includes a pivotable or hinged wall that swings towards the receptacle floor to receive an article without making a noise sufficiently loud to attract potential assailants or thieves hiding nearby.

To achieve the simplified, yet reliable, door closure control objective, an improved depository is constructed having an eccentric detent which pivots about one end under gravitational force so the detent is in position to engage stationary dogs within a recessed channel whenever an attempt is made to reopen the door once the closing motion has started. The detent enters an opening at the bottom of the channel when the door is fully closed so gravity rotates the eccentric detent to a position which permits the detent to pass smoothly through the channel without engaging the stationary dogs during the opening of the door. The interaction of the gravity-assisted detent with the stationary dogs positioned along the walls of the recessed channel during the closing of the depository door provides a simple mechanism for preventing, until the door is fully closed, the reopening of the depository door.

The silent operation of the hinged wall is accomplished by reducing the spatial clearance separating the edges thereof from the sides of the article receptacle. A gap is provided between the unattached end of the hinged wall and a portion of the depository door that is larger than the spatial clearance. The clearance is sized to retard the escape of the air trapped underneath the hinged wall while the gap permits the trapped air to escape. As the free end of the wall pivots about the outboard end of the receptacle floor, the flow of trapped air through the gap slows the descent of the hinged wall free end until it rests on the receptacle floor. The air cushioned impact of the free end and the receptacle floor produces substantially less noise than the impact of a free-falling hinged wall against the receptacle floor.

Quiet operation is enhanced by arcuately shaping the hinged wall such that the concave side thereof confronts the receptacle floor. As such, the concave side of the wall facing the receptacle floor captures a larger volume of air as the wall falls toward the floor, which has the effect of dampening or retarding the motion of the wall as it falls toward the receptacle floor than would otherwise be the case were the wall flat.

One advantage of the present invention is a night depository is provided that jams less frequently since fewer moving parts are required for operation of the depository.

Another advantage of the present invention is a depository that is easier to build and relatively inexpensive compared to more structurally complicated depositories.

These and other objects and advantages of the present invention are apparent from the reading of the following description made in connection with the accompanying drawings.

DETAILED DESCRIPTION OF THE PREFERRED EMBODIMENT

Figure 1:
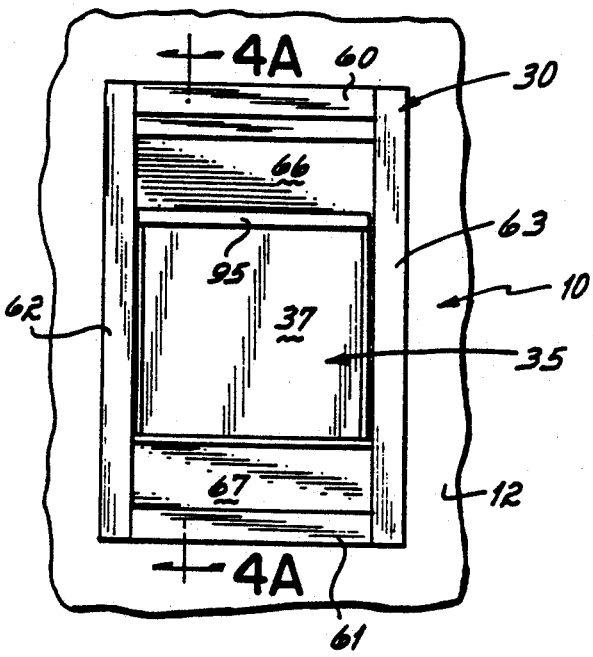
FIG. 1 is a front view of the depository placed within an opening of a building wall.
Figure 2:
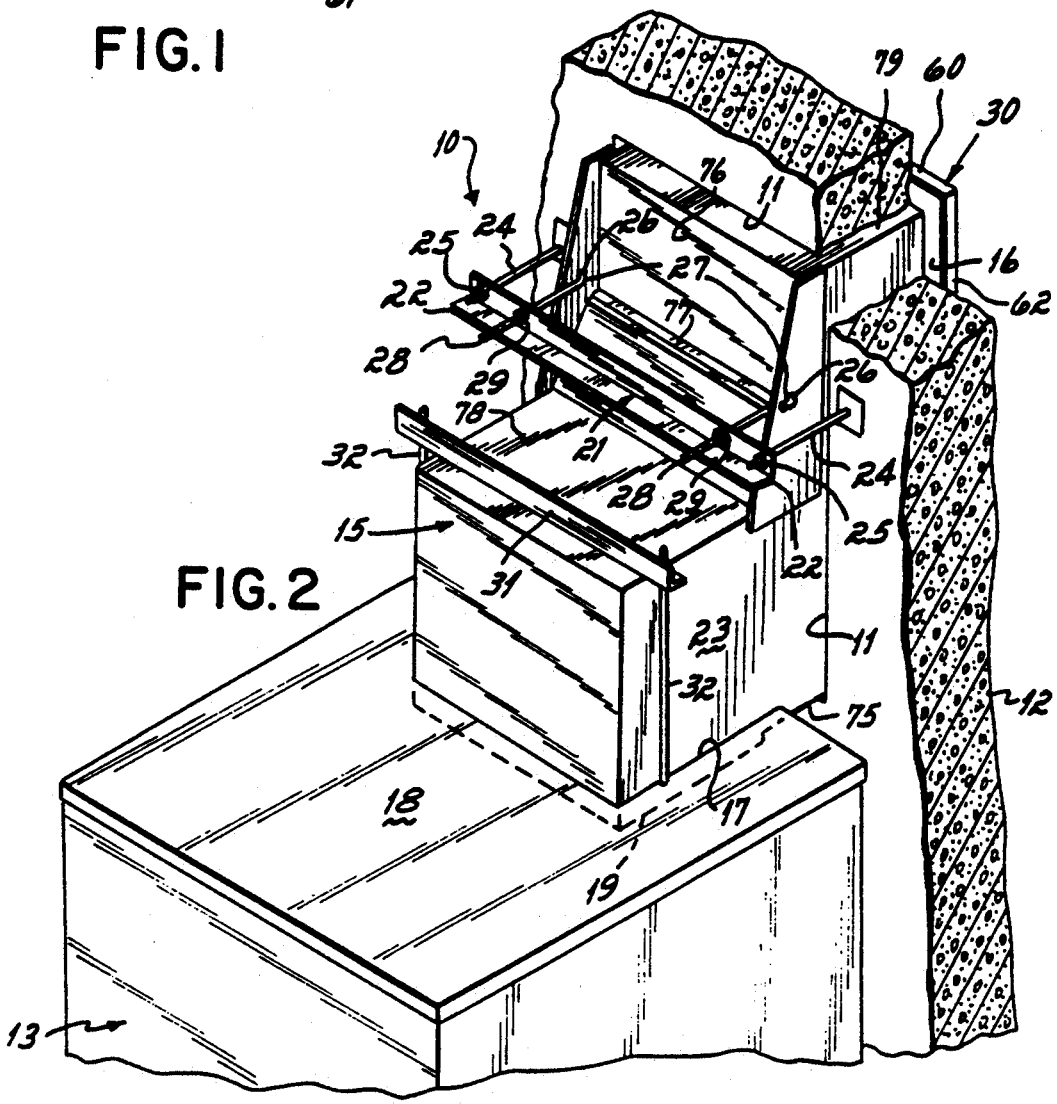
FIG. 2 is a perspective view of the depository as seen from inside the wall.
Figure 3:
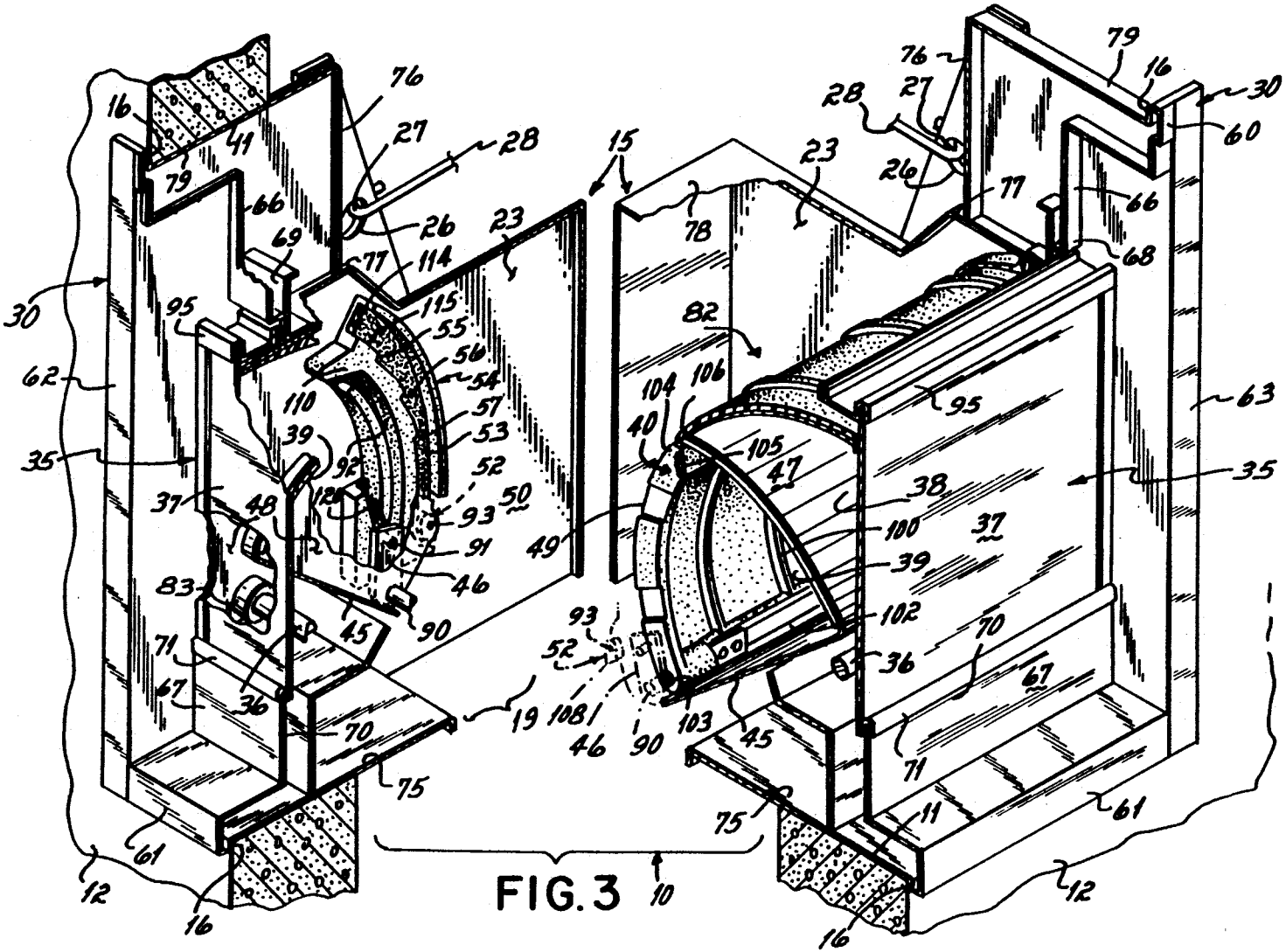
FIG. 3 is a fragmentary disassembled front view of the major components forming the depository constructed according to the principles of the present invention.

FIGS. 1, 2, and 3 show a depository 10 for permitting the deposit of articles through an opening 11 in a wall 12 into a receiving safe or vault 13. The depository has a housing 15 which fits within opening 11 and a peripheral flange 16 which engages the outer surface of wall 12. Vault 13 is located behind wall 12 and has an opening 17 in the upper surface 18.

Figure 4A:
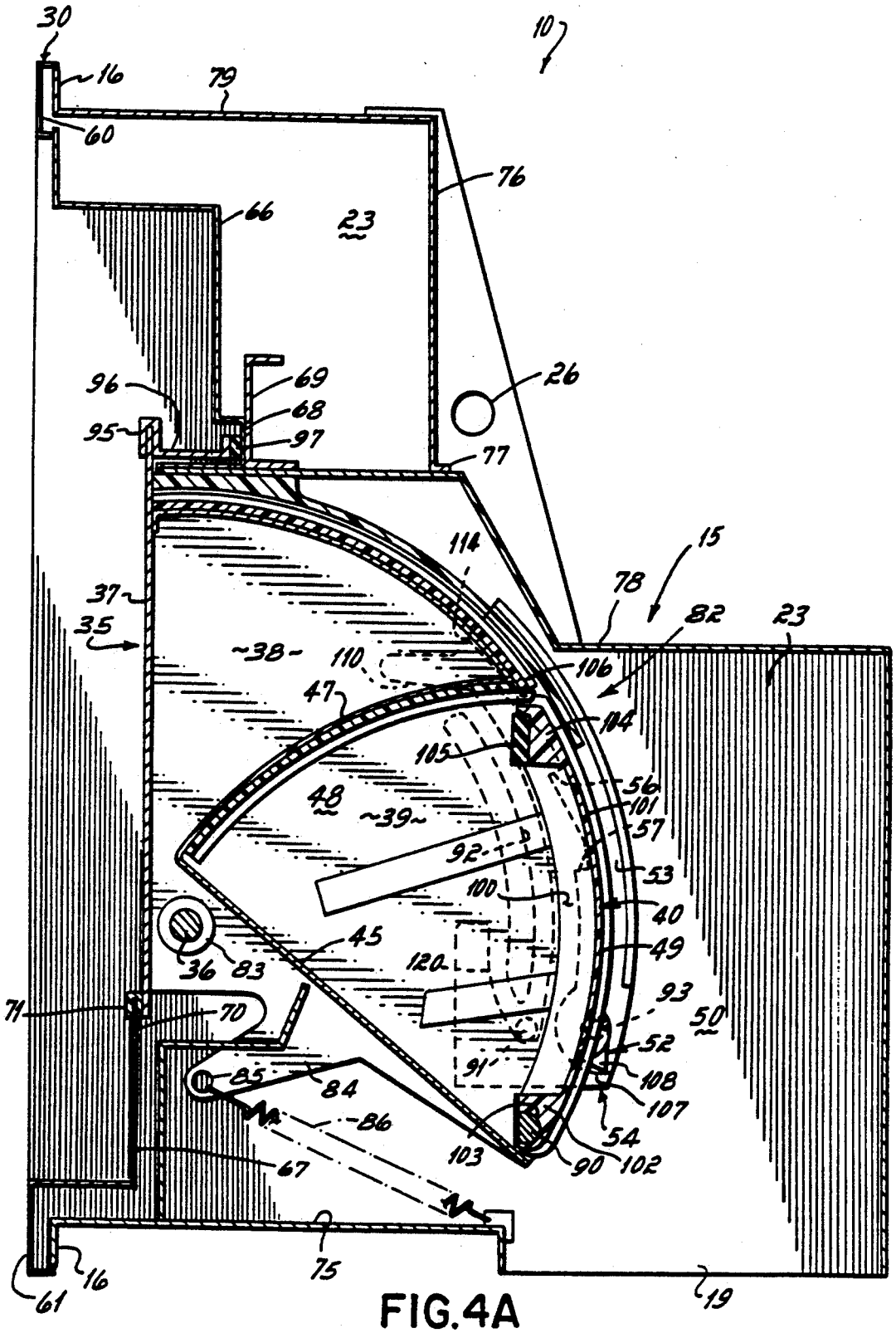
FIG. 4A is a cross-sectional view of the depository along lines 4A—4A of FIG. 1 with the depository door in the closed position.

As shown in FIGS. 3 and 4A, housing 15 encloses a receptacle assembly 35 that is mounted within housing 15 for pivotal motion about a door shaft 36. Receptacle assembly 35 includes a door 37, door sector 38, receptacle 39, and movable or hinged wall 40. When door 37 is rotated in a counterclockwise direction about door shaft 36, receptacle 39 is brought forward to expose a depository opening 41 (FIG. 4D) for deposit of an article, such as an envelope or money bag. During the counterclockwise rotation of receptacle assembly 35, movable wall 40 is urged downwardly towards a receptacle floor 45 by the movement of an actuating link arm 46 as explained in more detail below. Air trapped between movable wall 40 and floor 45 is slowly expelled about the free end of movable wall 40 as it falls because the clearance between movable wall 40 and side walls 48 forming receptacle 35 are relatively tight. The controlled expulsion of the trapped air cushions the fall of movable wall 40 so its impact with receptacle floor 45 makes minimal noise.

After the article is placed on upper surface 49 of movable wall 40, depository 10 is closed by rotating receptacle assembly 35 in a clockwise direction. During this motion, actuating link arm 46 urges movable wall 40 in a clockwise direction to eject the article from surface 49 into discharge area 50 so the article falls into vault 13.

FIGS. 3 and 4A also show an eccentric detent 52 pivotably mounted to one of the side walls 48 of receptacle assembly 35. Detent 52 travels through a recessed channel 53 formed in a guide plate 54 that is attached to a side wall 23 of depository casing or housing 15. Recessed channel 53 has stationary latching dogs 55, 56, 57 formed along outer wall 51 of channel 53 that engage detent 52 once the detent has passed dog 55 during the counterclockwise rotation of receptacle assembly 35 as depository door 37 is closed (FIG. 4E). The engagement of detent 52 and one of the stationary dogs within the channel causes detent 52 to jam within channel 53, as described in detail below, and halt the counterclockwise movement of receptacle assembly 35 during the closing of depository 10. The detent and channel stationary dogs cooperate to provide a simple, yet reliable and effective, mechanism for ensuring complete closure of the depository and the deposit of the article within vault 13.

As shown in FIG. 2, the depository frame or housing 15 is secured to the inside of wall 12 by sandwiching the wall between the peripheral flange 16 and a mounting angle 21. Angle 21 extends across the rear of housing 15 so that each end 22 projects beyond side walls 23 of housing 15. A threaded rod 24 is anchored to wall 12 on each side of opening 11. The free ends of those rods 24 are received in bores formed in the ends 22 of angle 21 and nuts 25 on each side of the bores secure angle 21 in position. Each housing wall 23 has a hole 26 which receives a hook end 27 of a threaded rod 28. The free end of each rod 28 passes through a hole in angle 21 where it is secured by a nut 29. When nut 29 is threaded onto rod 28, flange 16 of housing 15 is pulled tight against the outer surface of wall 12 because angle 21 has been fixedly positioned in place behind the opening by anchored rod 24 and nuts 25. Flange 16 is hidden from view by a rectangular front cladding 30.

Depository housing 15 is secured to the vault or receiving safe 13 by a clamp angle 31 and a pair of threaded rods 32 as shown in FIG. 2. Rods 32 are welded or otherwise secured to the top 18 of the safe and project above the top of housing side walls 23. Clamp angle 31 is seated on the upper surface edge of housing walls 23 with the rods projecting through the angle. Nuts (not shown) are received on rods 32 and tightened to clamp the angle and hence the depository housing to safe 13 with a discharge on chute 19 projecting into opening 17 of safe 13.

In further detail and with reference to FIGS. 1 and 3, cladding 30 surrounding opening 11 and frame or housing 15 includes a top 60, bottom 61 and two sides 62, 63. An upper plate 66 extends from top 60 and a lower plate 67 extends upwardly from bottom 61. Upper plate 66 stair steps inwardly to its lower end 68 which is attached to a mounting bracket 69. Mounting bracket 69 is preferably attached to lower end 68 of upper frame plate 66 by welding or other similar means. In a similar fashion, lower frame plate 67 stair steps inwardly from frame bottom 61 to its upper end 70. Mounted at the end of upper end 70 of lower frame plate 67 is a U-shaped seal 71 which prevents moisture or the like from entering at the lower edge of opening 41. Bottom frame plate 75 having the lower portion of peripheral flange 16 fits over the bottom of opening 11 in wall 12. Upper frame plate 76 is attached at its lower end 77 to depository casing 78 of housing 15 and has at its upper end 79 the upper portion of peripheral flange 16. The two side plates 23, each having a mounting opening 26, are attached to each side edge of casing 78, upper frame plate 76 and lower frame plate 75. As mentioned above, holes 26 provide a means for securely mounting housing 15 within opening 11. Depository casing 78 extends rearwardly or inwardly from opening 11 to form discharge region 50 over vault 13. The opening between the rearward end of bottom frame plate 75 and the lowermost end of depository casing 78 forms depository discharge or chute 19.

As shown in FIG. 2, depository discharge 19 communicates directly with vault opening 17 although the discharge could communicate indirectly with vault opening 17 through chute extensions, duct work, or the like, not shown. Depository casing side plates 23 of depository casing 78 are attached along their periphery to depository casing top plate 66, frame bottom plate 75 and lower frame plate 67 to enclose depository 10. Top plate 66 is attached to the lower end of bracket 69 and upper frame plate 76 at end 77 as well as mounting plate or housing side walls 23. The plate members or side walls of the depository casing are preferably constructed of reinforced steel though other sturdy materials well known within the field may be used. While the preferred method of attaching the depository plate members together and attaching the casing to the frame is by using nuts and bolts appropriately sized for the weight of the selected plate material as is well known within the art, the plates could be welded together and the casing welded to the frame.

As shown in FIG. 4A, repository section 82, housed within depository 10, is formed by pouch or receptacle assembly 35 and guide plate 54. Guide plate 54 is attached to one of the depository casing side plates 23. Although two such guide plates could be mounted, one to each casing side plate, such duplication is not necessary for the practice of the present invention. Guide plate 54 is preferably mounted to side casing plate 23 by means of screws (not shown), although other attachment members or methods could be used. Guide plate 54 is preferably constructed from a plastic resin material to reduce its weight and improve the wear life of the channel and slot formed therein, although other materials having similar properties may be used as well.

Referring now to FIGS. 3 and 4A, receptacle assembly 35 includes door 37 attached to door sector 38 that is mounted about a free rotating shaft 36. Shaft 36 is mounted in a bearing (not shown) secured to side plates 23 of housing 15. Shaft 36 is mounted in bearings to frustrate an attempt to cut the shaft with a saw inserted between the hopper and its pivot. While shaft 36 extends across housing 15 from one side of to the other side in the preferred embodiment, two pivot pins mounted through the receptacle sides into the side depository casing plates could be used instead.

With further reference to FIG. 3, receptacle side plate 48 is shown having a hub 83 which contains a sleeve bearing through which door shaft 36 is placed. Leg 84 extends from one plate 48 and has a spring retaining hole 85 through which one end of a spring 86 is mounted. At the lower outboard end of each receptacle side plate 48 is a mounting hole through which a movable wall shaft 90 is rotatably mounted. Link arm 46 is fixedly mounted on one end of wall shaft 90. Cam follower 91 extends outwardly from link arm 46 towards guide plate 54 on depository casing side plate 23. Cam follower 91 cooperates with a cam slot 92 in guide plate 54 to control the movement of the movable wall as explained in more detail below. Along the arcuate, rearmost edge of the receptacle side plate 48 adjacent to guide plate 54, eccentric detent 52 is pivotably mounted about a mounting member 93.

FIGS. 3 and 4A further show receptacle floor 45 extending from door sector 38 and attached to receptacle side plates 48. Spring 86 is also connected to bottom frame plate 75 to provide a biasing action that counters the pulling force needed to open depository 10. Door 37 has a handle 95 mounted at its uppermost end. When door 37 covers depository opening 41, segment 96 of handle 95 fits snugly over the portion of depository casing 15 that extends beyond upper frame plate 66. Segment 96 carries a seal 97 which seats against the lowermost edge 68 of frame plate 66. As can be seen from comparing FIGS. 4A–4F, receptacle assembly 35 pivots about shaft 36 whenever door handle 95 is pulled counterclockwise to open depository 10. When handle 95 is pushed clockwise to close depository 10, the biasing action of spring 86 urges receptacle assembly 35 to a position which ensures door seal 97 engages the frame. Sector 38 of door 37 extends rearwardly from the door to increase the distance between receptacle 39 and door 37 to discourage drilling attempts through the door to reach the receptacle.

As shown in FIG. 4A, movable wall 40 is molded and includes at least two ribs 100 longitudinally spaced to form a support frame for upper wall surface 101. At one end of ribs 100 is a boss 102 having mounting hole 103 which is used to fixedly mount movable wall 40 upon shaft 90. Upper wall surface 101 extends beyond ribs 100 at the outboard or free end 104 to provide a seat for a cushion 105. The cushion 105 reduces the impact of wall 40 with floor 45 when wall 40 falls forward during depository opening. Movable door 40 is preferably molded from lightweight yet sturdy plastic resins though other suitable materials may be used. While wall 40 is preferably arcuate shaped, wall 40 may be flat or any shape that ensures the free end of the wall passes close enough to front wall 47 of receptacle 39 as shaft 90 is pivoted by link 46 to ensure the receptacle is swept out when the depository is closed.

As shown in FIG. 4A, movable wall 40 pivots about shaft 90 which is mounted between receptacle side plates 48. When door 37 is completely closed, wall 40 is in a position where movable wall free end 104 is proximate door sector end 106 that is most remote from door 37. In this position, movable wall 40 encloses the rearward side of receptacle area 39 so movable wall 40 is interposed between receptacle area 39 and discharge region 50. This provides an additional barrier to vault opening 17 should one be able to cut through door 37 and wall 47 to gain access to receptacle area 39. Link arm 46, also mounted on shaft 90, is substantially vertical so that cam follower 91 lies at the lowestmost end of cam slot 92 in guide plate 54. In the door closed position, eccentric detent 52 rests within detent opening 107 at the lowermost end of recessed channel 53 with detent free end 108 hanging from mounting member 93 without binding against the lowermost end of detent opening 107.

Figure 4B:
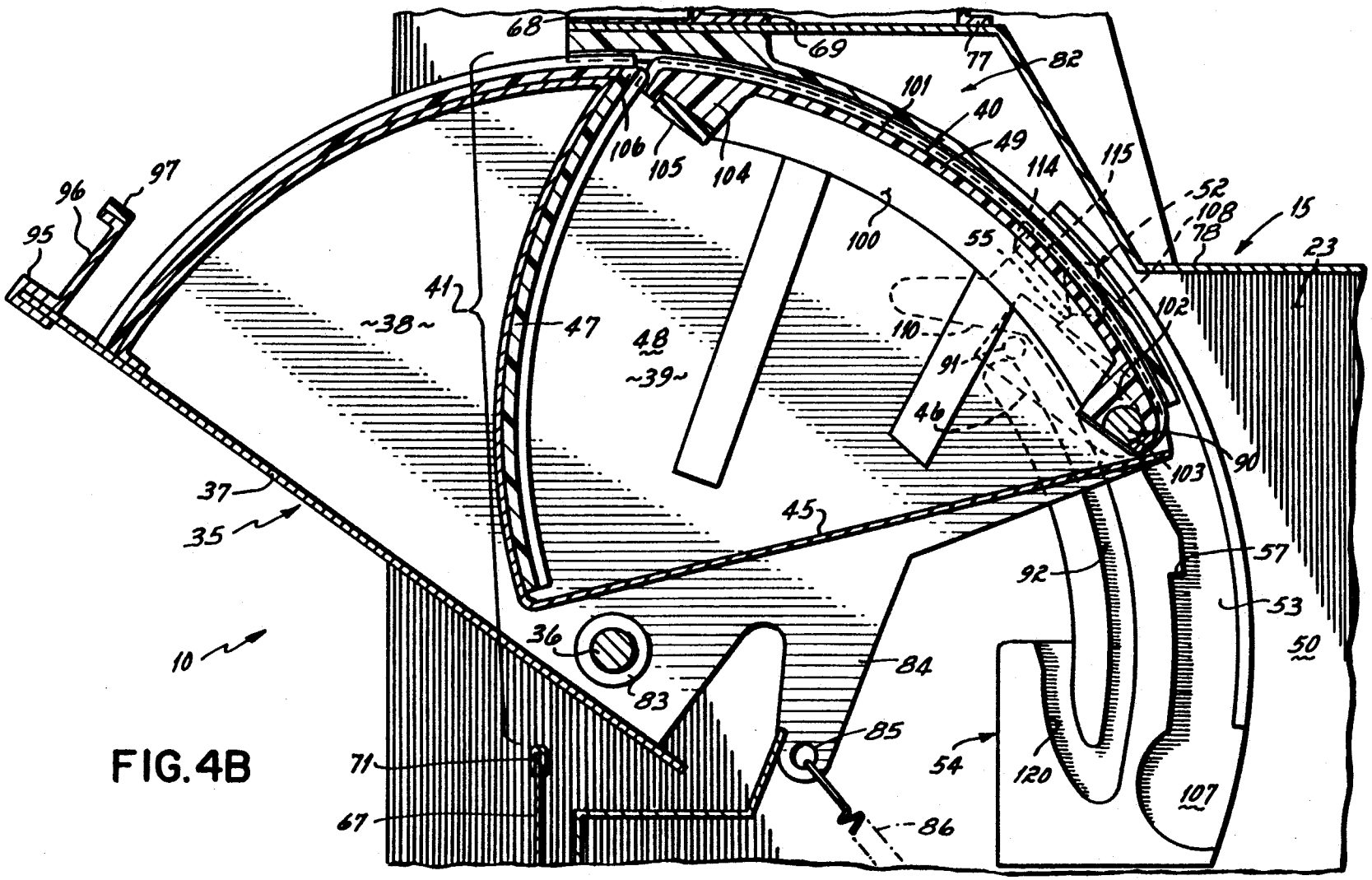
FIG. 4B is a fragmentary cross-sectional view of the depository along lines 4A—4A with the depository door pivoted to a position where the front edge of the article receptacle is even with the opening in the building wall.

In FIG. 4B, receptacle assembly 35 is shown pivoted about door shaft 36 so door sector end 106 is proximate opening 41 of depository casing 78. In this position, cam follower 91 has moved within cam slot 92 so it is urged against shoulder 110. Detent 52 has followed the outermost edge of recess channel 53 which is smooth.

Figures 4C, 5:
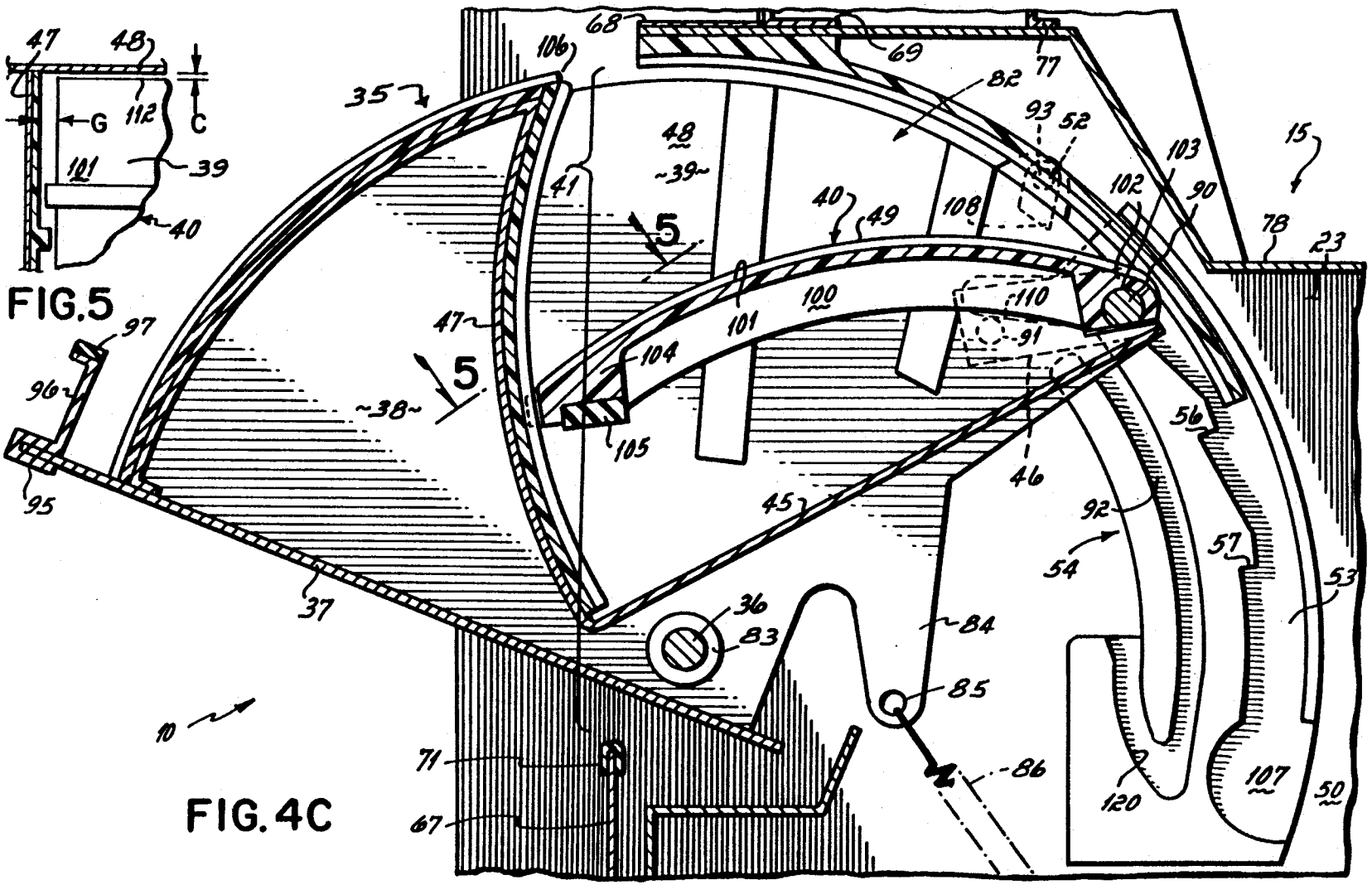
FIG. 4C is a fragmentary cross-sectional view of the depository along lines 4A—4A where the door has been further pivoted to a position so that a forward portion of the article receptacle extends beyond the opening in the building wall.
FIG. 5 is a fragmentary view taken along lines 5—5 of FIG. 4C.

FIG. 4C shows the action of shoulder 110 on cam follower 91 as receptacle assembly 35 is further forwardly pivoted about door shaft 36. Shoulder 110 blocks the further upward movement of cam follower 91 causing link arm 46 to crank shaft 90 and movable wall 40 into counterclockwise motion. Once this motion of movable wall 40 has begun, the wall continues to fall under the pull of gravity. As wall 40 falls towards receptacle floor 45 air is trapped between wall 40 and floor 45.

As shown in FIG. 5, a depository constructed according to the principles of the invention has a spatial clearance "C" between each longitudinal edge 112 of movable wall 40 and receptacle side plate 48 and a gap "G" between free end 104 and wall 47. The clearance "C" is sufficiently tight enough to prevent the rapid expulsion of air between longitudinal edge 112 and plate 48 as wall 40 falls. Instead, the air escapes through gap "G" at a rate sufficiently fast to permit the controlled descent of wall 40 without producing noise when outboard end 104 impacts the floor of the receptacle. In the preferred embodiment of the invention, the clearances "C" and gap "G" are approximately 0.062" and 0.25", respectively.

Figure 4D:
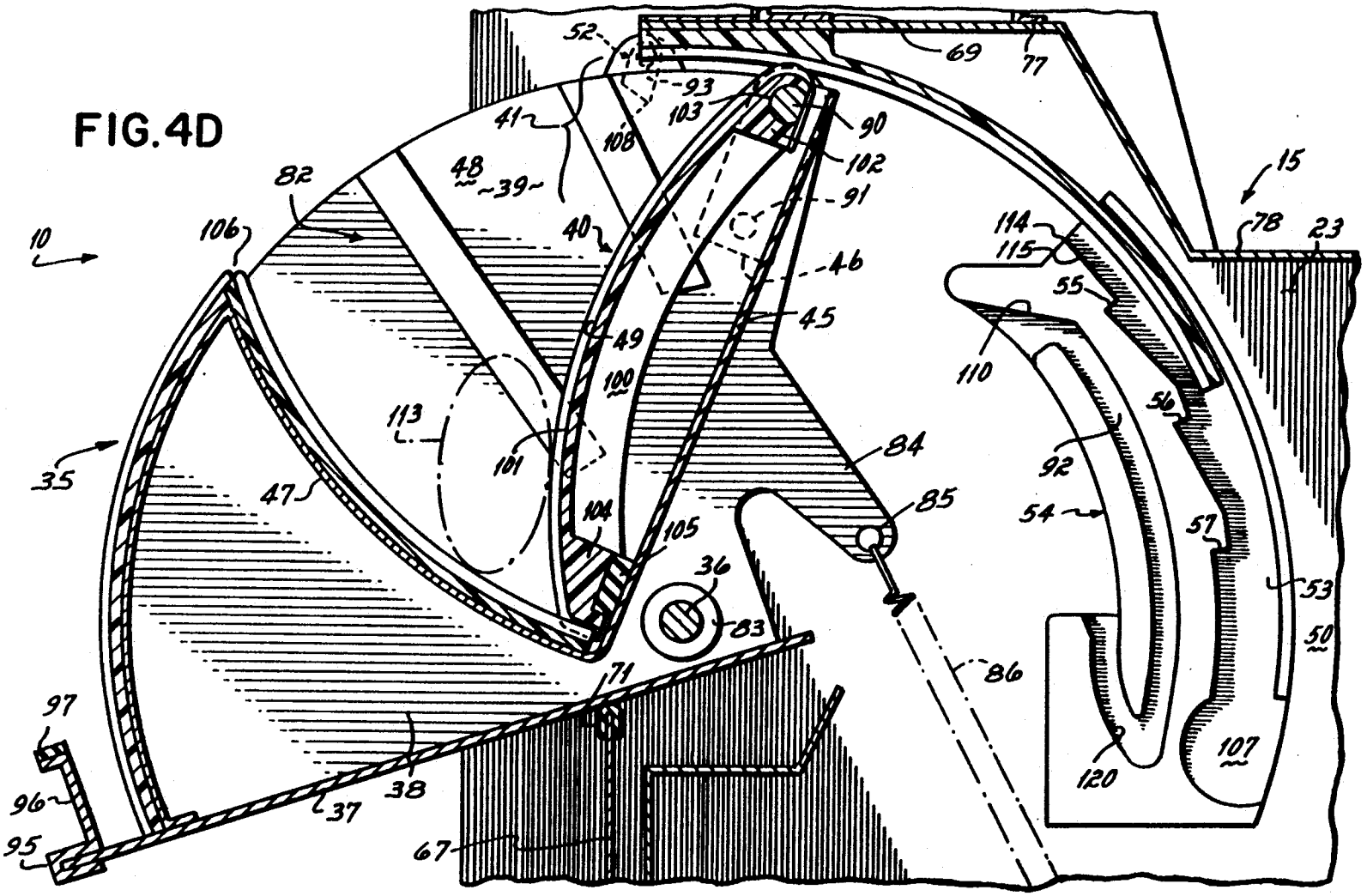
FIG. 4D is a fragmentary cross-sectional view along lines 4A—4A with the depository door in the fully opened position.
Figure 4E:
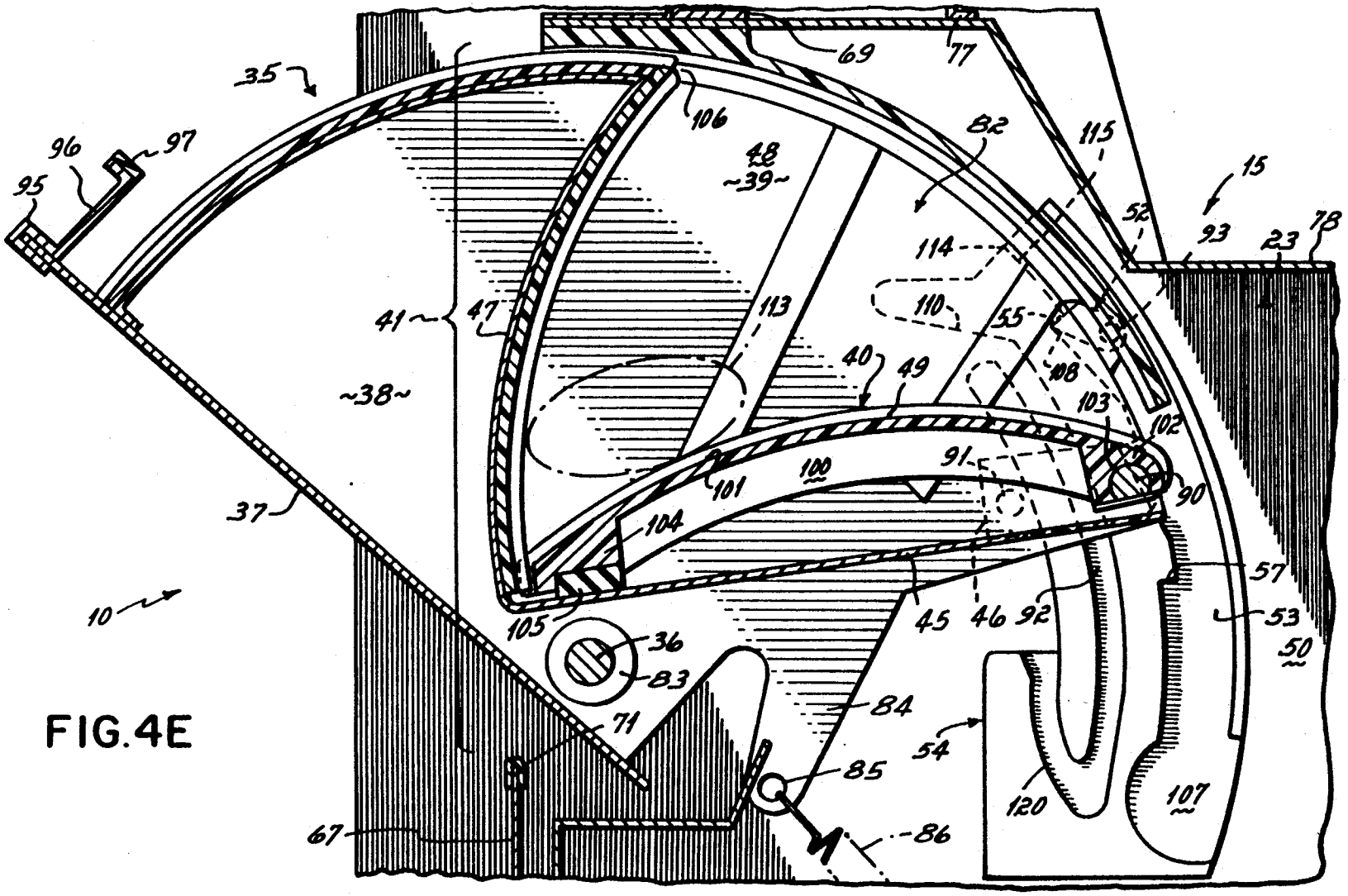
FIG. 4E is a fragmentary cross-sectional view of the depository along lines 4A—4A to show the position of the door detent within the recessed channel during the closing of the door.

As the trapped air is expelled from underneath the movable wall, via the spatial clearances around the wall edges, by the wall as it descends under its own weight, the free end 104 of the wall floats downwardly until cushion 105 contacts floor 45 as shown in FIG. 4D. Article 113, such as an envelope or money bag, can now be deposited within the open receptacle 39 so that it rests between movable wall 40 and the front wall 47 of receptacle 39.

As shown in FIG. 4E, when receptacle assembly 35 is pivoted in a clockwise manner about door shaft 36, cam follower 91 of link arm 46 returns along the outside edge of guide 54 and not through the cam slot 92 because the movement of the receptacle floor 40 during opening positions the cam follower 91 of arm 46 outboard of the plate 54 and its cam slot 92.

During closure, a lip 114 on the outer wall of channel 53 engages the longer, or free, end 108 of eccentric detent 52 so detent 52 rotates and enters recessed channel 53 with its pivoted end leading. As receptacle assembly 35 is further rotated about shaft 36, the long end 108 of detent 52 follows detent mounting pin 93 into recessed channel 53 and is supported by the inner channel wall 115. After free end 108 of detent 52 passes by the first stationary dog 55, counterclockwise rotation of receptacle assembly 35 is prevented because the free end 108 engages stationary dog 55. This action halts the counterclockwise rotation of receptacle assembly 35 at a point which does not expose receptacle area 39 through opening 41. The cooperation of detent 52 and latch dogs 55, 56, 57 ensures the receptacle is completely closed to eject the article 113 prior to being reopened.

As receptacle assembly 35 is further rotated in a clockwise fashion and as free end 108 of detent 52 slides past the second and third stationary dogs 56, 57, any attempt to rotate the receptacle assembly in a counterclockwise fashion results in detent 52 engaging the last stationary dog passed to permit less and less counterclockwise rotation.

Figure 4F:
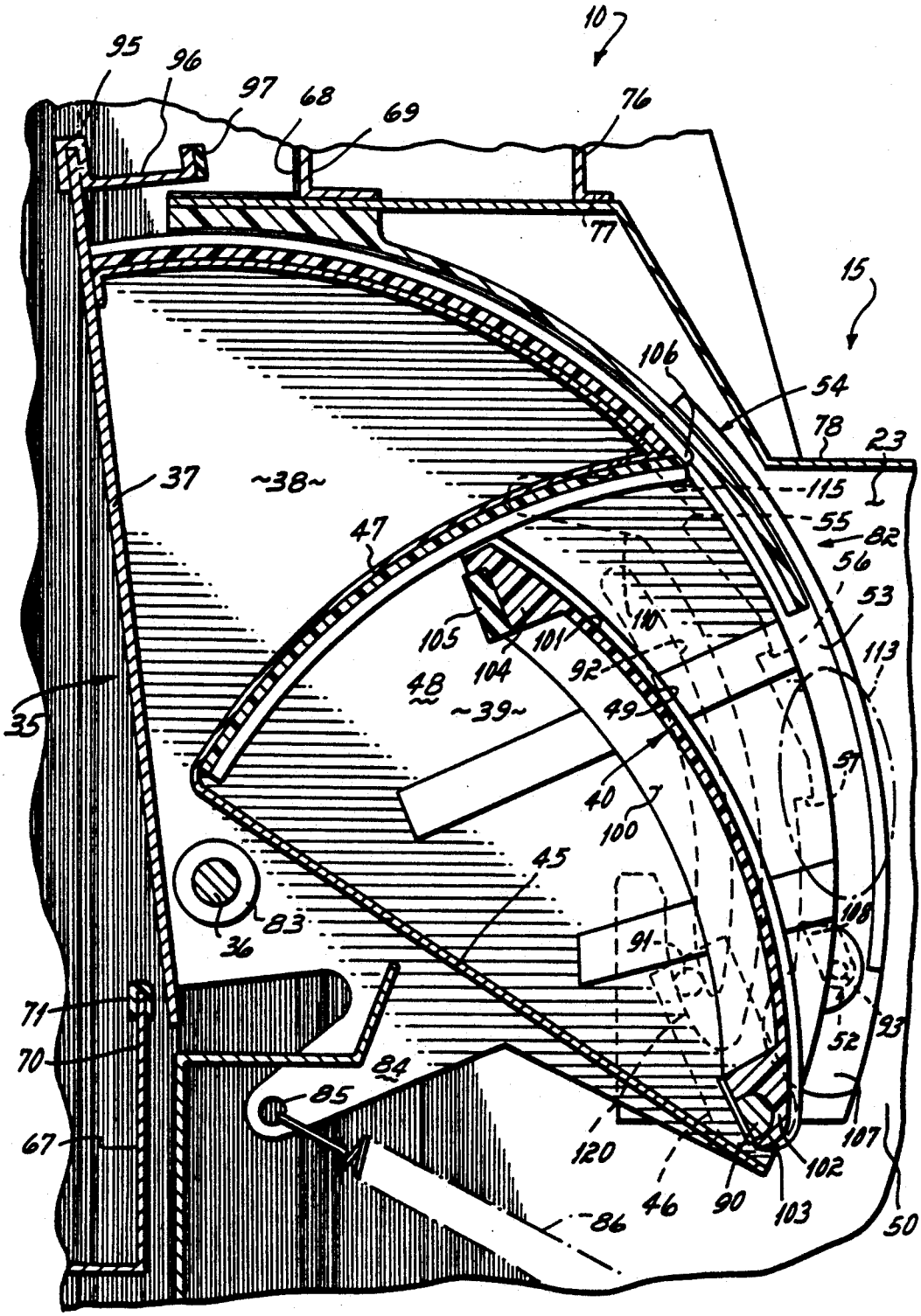
FIG. 4F is a fragmentary cross-sectional view along lines 4A—4A of the depository showing the hinged wall in the article ejecting position and the relationship of the detent to the opening at the lower end of the recessed channel just prior to the closing of the door.

As shown in FIG. 4F, the continued clockwise rotation of receptacle assembly 35 causes cam follower 91 to engage a floor closure cam surface 120 of cam slot 92 which acts through link arm 46 to urge movable wall 40 outwardly. This movement of wall 40 ejects article 113 resting on the upper surface 101 of wall 40 into discharge region 50 of depository 10 as is well known within the art. Article 113 then falls into vault 18. When door assembly 35 is fully closed, movable wall 40 and detent 52 are once again in the positions depicted in FIG. 4A, enabling the door to be re-opened, if desired.

While the invention has been described in connection with a presently preferred embodiment, those skilled in the art will recognize many modifications of structure, arrangements, portions, elements, materials, and components can be made in the practice of this invention without departing from the principles thereof.

What is claimed is:

1. A night depository for the secure placement of articles within a receptacle for emptying into a bank vault comprising:

a receptacle with a door, floor and two vertical, parallel sides having interior and exterior surfaces, said door and said floor being located intermediate said sides with said door joined along a lower portion thereof to a forward portion of said floor, each being joined to each of said sides, means for mounting said receptacle in an opening in a building wall, said receptacle being mounted for pivotal motion about a first horizontal axis proximate the lower edge thereof between a first position of travel wherein said door is flush against said mounting means so said door covers an opening portion not covered by said mounting means and a second position of travel about said horizontal axis wherein said floor substantially blocks said opening portion and said door is angularly disposed outwardly of said building wall; and a movable wall having two edges and two ends with one of said ends being mounted about a second horizontal axis proximate the edge of said floor remote from said door so said movable wall may be pivotably moved about said second horizontal axis, an unmounted end of said movable wall being pivoted away from said floor when said receptacle is at said first position of travel and pivoting toward said floor when said receptacle is pivoted to said second position of travel, said unmounted end being separated from said door by a gap of approximately 0.25 inches when pivoting towards said floor, said edges of said movable wall being separated from said interior surfaces of said receptacle vertical sides by a spatial clearance of approximately 0.062 inches that is less than said gap so that the air trapped underneath said movable wall is expelled along said unmounted end through said gap at a rate which cushions the fall of said movable wall to said floor to reduce the noise from said unmounted end of said movable wall end impacting said receptacle floor.

2. A night depository for the secure placement of articles within a receptacle for emptying into a bank vault comprising:

a receptacle with a door, floor and two vertical, parallel sides having interior and exterior surfaces, said door and said floor being located intermediate said sides with said door joined along a lower portion thereof to a forward portion of said floor, each being joined to each of said sides, means for mounting said receptacle in an opening in a building wall, said receptacle being mounted for pivotal motion about a first horizontal axis proximate the lower edge thereof between a first position of travel wherein said door is flush against said mounting means so said door covers an opening portion not covered by said mounting means and a second position of travel about said horizontal axis wherein said floor substantially blocks said opening portion and said door is angularly disposed outwardly of said building wall; and an eccentric detent having first and second ends, said first end being pivotably mounted to said exterior surface of one of said receptacle sides, said second end of said detent freely extending downwardly from said pivotably mounted end in response to gravity; and a detent track mounted adjacent said side to which said detent is mounted, said detent track having a recessed channel with an upper and a lower end to receive said detent, said recessed channel having an outer wall distal from said door and an inner wall opposite said inner wall, one of said walls having at least one stationary dog, said channel being sufficiently wide at said lower end so that said free end of said detent extends downwardly from said pivoted end of said detent under gravitational force when said receptacle is at said first position of travel, said inner wall and said outer wall being sufficiently spaced apart so said detent passes up through said recessed channel with said free end extending substantially downward from said pivoted end as said receptacle reaches its second position of travel, said upper end being sufficiently narrow that said free end contacts said upper end as said receptacle moves from said second position of travel to said first position of travel, enabling said free end of said detent to pivot about said pivoted end and extend substantially upwardly from said pivoted end as said pivoted end enters said recessed channel, to in turn insure that once said free end passes said stationary dog on one of said recessed channel surfaces as said detent moves downwardly through said channel a reversal of said receptacle direction of travel will cause said free end to remain above said pivoted end and engage said stationary dog, thereby halting the reversal of direction of movement of said receptacle until said detent passes through said lower end of said recessed channel at said first position of travel whereupon said free end pivots to a position extending downwardly from said pivoted end, permitting door opening to be re-initiated if desired.

3. The night depository of claim 2 wherein one of said walls within said recessed channel has a plurality of stationary dogs.

4. The night depository of claim 2 wherein said eccentric detent is mounted to said exterior surface of said receptacle wall at a point along the edge distal from said door.

5. The night depository of claim 2 wherein said first end of said detent is rounded and the portion of said second end of said detent distal from said first end terminates into a sloping face that matches a sloping face of said stationary dog, said sloping face of said detent engaging said sloping face of said stationary dog when the direction of travel of said detent is reversed as said detent travels downwardly through said channel during movement of said receptacle from said second position of travel to said first position of travel.

6. The night depository of claim 2 wherein each surface within said recessed channel has at least one stationary dog.

* * * * *